US005098026A

United States Patent [19]

Dougan et al.

[11] Patent Number: 5,098,026

[45] Date of Patent: Mar. 24, 1992

[54] EASY ACCESS POP OFF RELIEF VALVE

[75] Inventors: Donald R. Dougan, Canton; Ronald D. Mizak, Wadsworth; Gerald W. Peters, Canal Fulton, all of Ohio

[73] Assignee: The Babcock & Wilcox Company, New Orleans, La.

[21] Appl. No.: 638,306

[22] Filed: Jan. 7, 1991

[51] Int. Cl.[5] ..... B02C 23/00

[52] U.S. Cl. ..... 241/101.2; 241/293; 277/2; 277/29; 384/466; 384/473

[58] Field of Search ..... 241/101.2, 293; 384/466, 473; 277/2, 29, 28

[56] References Cited

U.S. PATENT DOCUMENTS 2,582,734 1/1952 Adams ..... 241/293 X
2,610,092 9/1952 Shelden et al. ..... 384/466
3,498,620 3/1970 Wiese ..... 277/28 X

*Primary Examiner*—Mark Rosenbaum
*Assistant Examiner*—Frances Chin
*Attorney, Agent, or Firm*—Robert J. Edwards; Vytas R. Matas; Eric Marich

[57] ABSTRACT

A pulverizer roll wheel assembly comprises a bracket with an opening therein for fixing the outer end of a roller shaft. Bearings mount a roller wheel with pulverizing tire to the inner end of the shaft for rotation of the pulverizer. A lip seal assembly separates an oil space around the inner end of the shaft with an air space around the outer end of the shaft. A pop off relief valve normally positioned near the lip seal is repositioned to the outer face of the shaft for easier access. A cover extends over the relocated valve for extending the air space around the relocated valve.

15 Claims, 5 Drawing Sheets

EASY ACCESS POP OFF RELIEF VALVE

FIELD AND BACKGROUND OF THE INVENTION

The present invention relates in general to pulverizers and in particular to a new and useful pulverizer roller assembly with a pop off relief valve.

MPS type pulverizers are known from *STEAM/ITS GENERATION AND USE*, 39TH Edition, the Babcock & Wilcox Company, 1978, pp 9-7, 9-8. This, and any similar type of pulverizer utilizes a bearing support for a plurality of rollers that rolls in a race for crushing and pulverizing various materials, in particular coal.

Each roller or roll wheel assembly in an MPS or other similar pulverizer, is supported by a bearing structure with an enclosed oil supply. The oil supply is required to both cool and lubricate the internal bearing parts. During operation, air and gases within the enclosed oil supply space, heat up and expand. If this expansion is not released, damage will result to components in the bearing structure such as lip seals and O-rings.

To relieve this pressure buildup, a pop off relief valve is located in a remote area of the roll wheel assembly. This relief valve vents the expanded gas into a chamber containing seal air. Although a porous fixture has been considered for relieving this pressure buildup, a relief valve is used instead so that pressure tests can be conducted on the oil chamber using pressurized air.

Referring to FIG. 1, the known roll wheel assembly for an MPS pulverizer comprises a roller bracket 10 having an opening 11 which carries the outer end of a roll wheel shaft 12. A roll wheel 14 is mounted for rotation on an inner end of shaft 12 by a pair of axially spaced bearings 16 and 18. A space for lubricating and cooling oil is defined between the bearings and between an outer bearing spacer 20 and an inner bearing spacer 22 which circumferentially surround the shaft 12. A tire 24 of wear resistant material, is fixed to wheel 14, by an interference fit and a clamp ring 26 which is bolted to wheel 14. A ring shaped roller seal retainer 28 is connected by cap screws 30 to wheel 14 for rotation with the wheel. A lip seal assembly 32 retained by retainer 28, is slidably engaged against a ring shaped roll seal sleeve 34. Shaft 12 is retained in position on roller bracket 10 by a shaft retainer 36 bolted over an outer end face of the shaft 12 and shaft 12 is rotationally fixed to roller bracket 10 by a key 38. The bearings and spacers are held in position by a bearing retainer 40. Retainers 36 and 40 are bolted to opposite ends of shaft 12.

To keep the oil in the space around shaft 12, O-ring 45 is clamped between the wheel 14 and retainer 28 and two O-rings 47 are clamped within recesses in the shaft 12 and roll seal sleeve 34. The lip seal assembly 32 creates a rotating oil seal with the roll seal sleeve 34. The end of shaft 12 is further sealed by a plug 52 and O-ring 49. A bearing cover 42 is bolted to wheel 14 over an axial end of the space. An O-ring 44 is located between the bearing cover 42 and the wheel 14.

To insure that sufficient force is applied to the tire 24 downwardly onto the rack (not shown), pressure is applied to the bracket 10 by a pressure frame (not shown), at a roll pin block 46 which carries a roll pivot 48.

Oil is supplied to the oil space or chamber by an oil conduit 50 having an outer end closed by the plug 52 and O-ring 49. The opposite end of oil conduit 50 opens at the far end of the oil chamber. A radial extension 54 from oil conduit 50 is an internal vent which allows oil and gas to flow into the space around shaft 12 and under inner spacer 22.

A lubricating channel 56 is also provided in shaft 12 for communicating with the inner surface of sleeve 34.

As illustrated in FIG. 2, which is a greatly enlarged sectional view of an area around the roll seal retainer 28, roll seal sleeve 34 includes an axial passage 58 having an inner opening communicating with the oil chamber, and an outer opening covered by a pop off relief valve 60. When excess gas pressure occurs within the oil chamber, valve 60 opens and discharges the gas into an air seal space 62. A roll air seal 64 which is fixed to bracket 10 by cap screws 66, closes the air seal space and is slidably engaged with the roller seal retainer 28. Two lip seals 32 separate the oil space from the air seal space 62.

A major problem in maintaining the pop off relief valve 60 is its remote location. Since the pop off relief valve is a mechanical device which is sensitive to contamination, it requires periodic inspection and service. To inspect the valve, the roll wheel assembly must be removed from the pulverizer. For an MPS type pulverizer, three such assemblies are used in each pulverizer. This of course requires the pulverizer to be taken out of operation. The internal structure of the pulverizer must also be supported when removing the roll wheel assembly. The roll wheel assembly is also not easily removed since it may weigh as much as 35,000 pounds.

Once removed, each assembly must be further disassembled for access to the pop off relief valve in each assembly.

SUMMARY OF THE INVENTION

An object of the present invention is to greatly improve the accessibility of the pop off relief valve used in roll wheel assemblies.

According to the invention, the pulverizer operator need no longer disassemble the pulverizer or its roll wheel assembly. The pop off relief valve may be inspected, cleaned or changed from within the pulverizer housing with the removal of only a few easily accessible parts.

According to the present invention, the original location for the pop off relief valve is plugged and a special ported key is used along with a ported roll shaft retainer and closed retainer cover which forms an expanded seal air cavity. The relief valve is relocated to the outer end of the oil conduit, and vents into the expanded seal air cavity.

According to the present invention, access is thus provided to the relief valve by simply removing the retainer cover without any further disassembly. The relief valve can thus be checked, cleaned and if required, replaced, without removing the roll wheel assembly from the pulverizer and without disassembling the roll wheel assembly.

DESCRIPTION OF THE PREFERRED EMBODIMENTS

Figure 1:
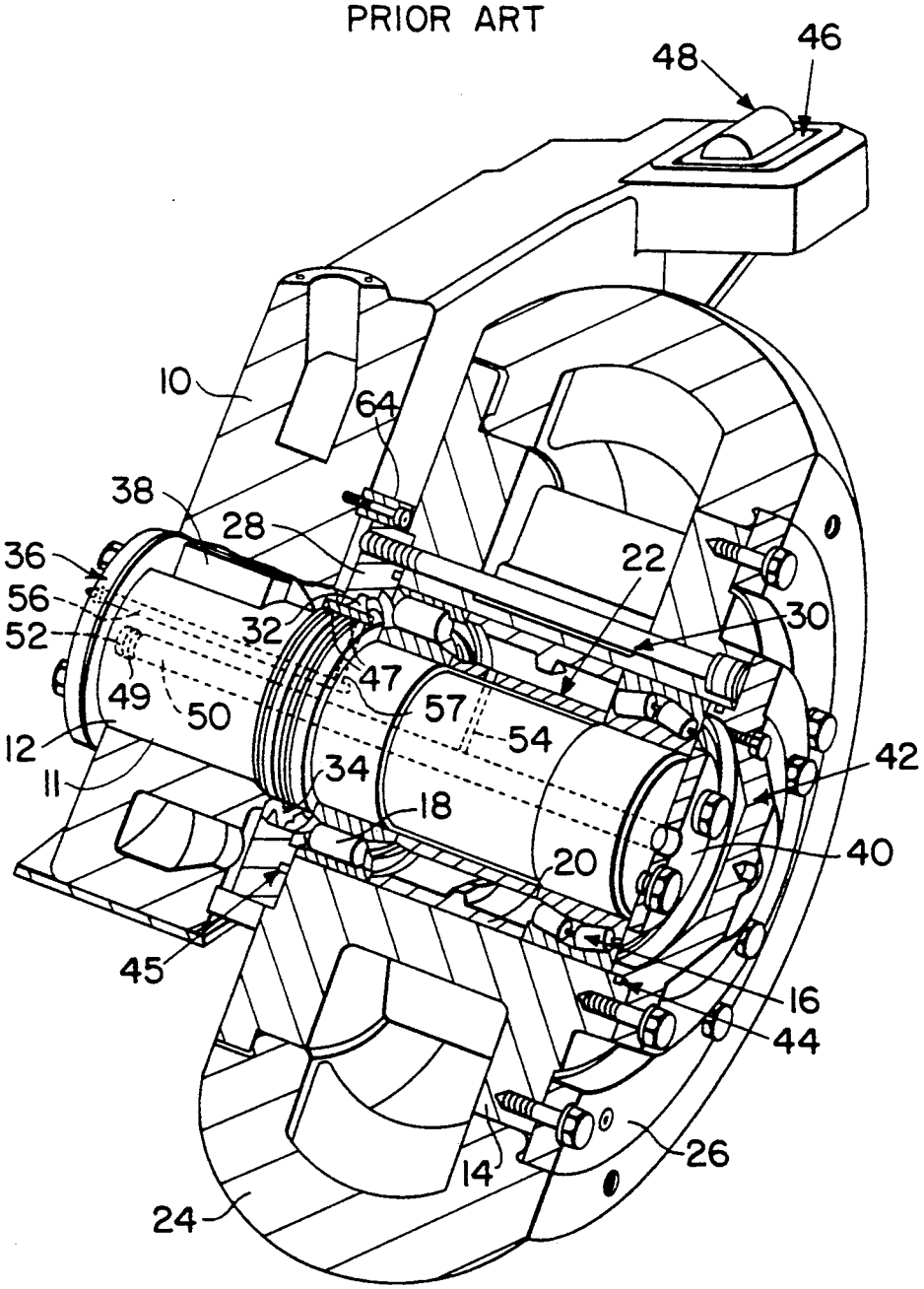
FIG. 1 PRIOR ART
FIG. 1 is a perspective view, partly in section, of a known roll wheel assembly for an MPS type pulverizer.
Figure 3:
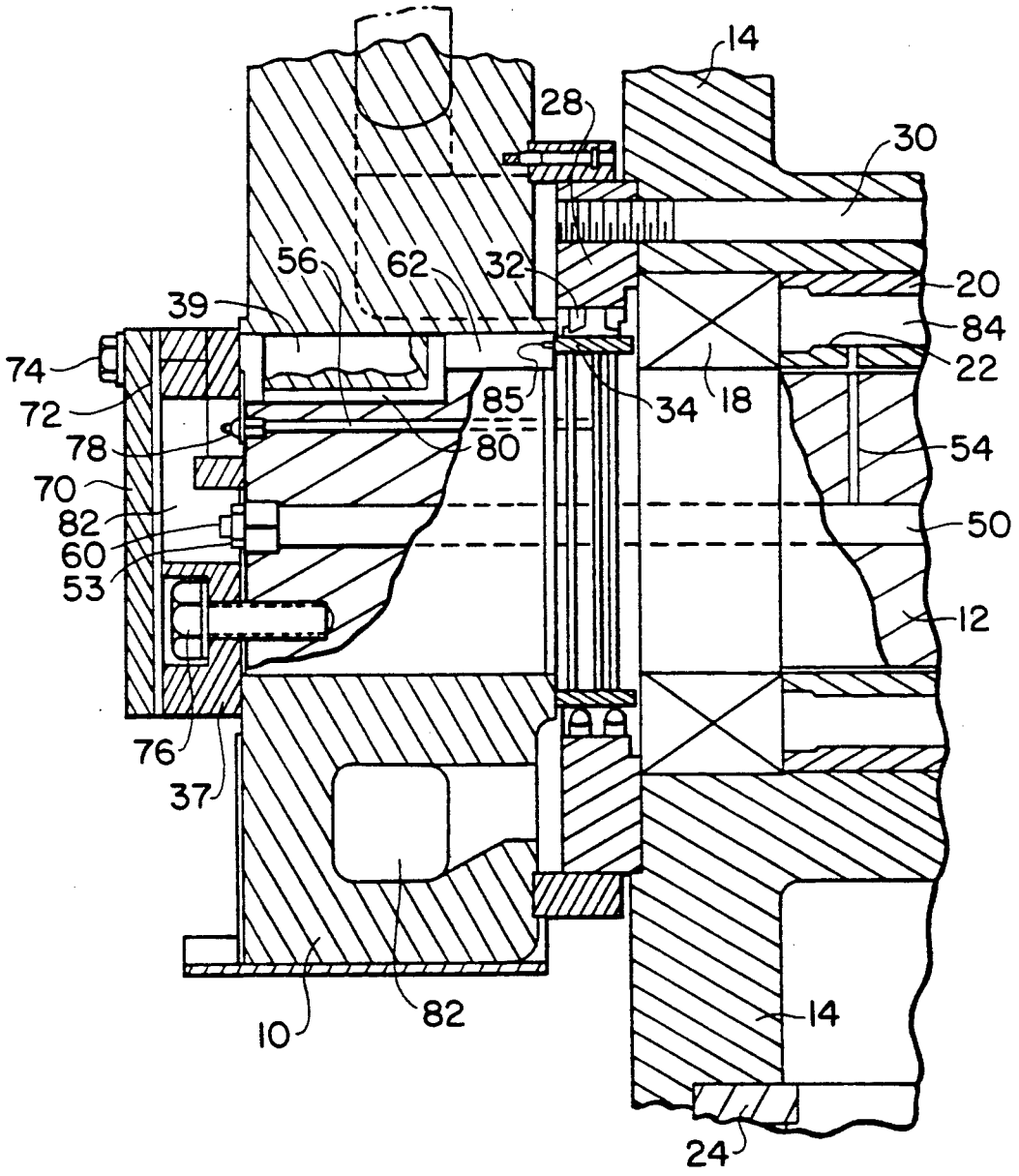
FIG. 3 is a partial sectional view of the roll wheel assembly according to the present invention.
Figure 4:
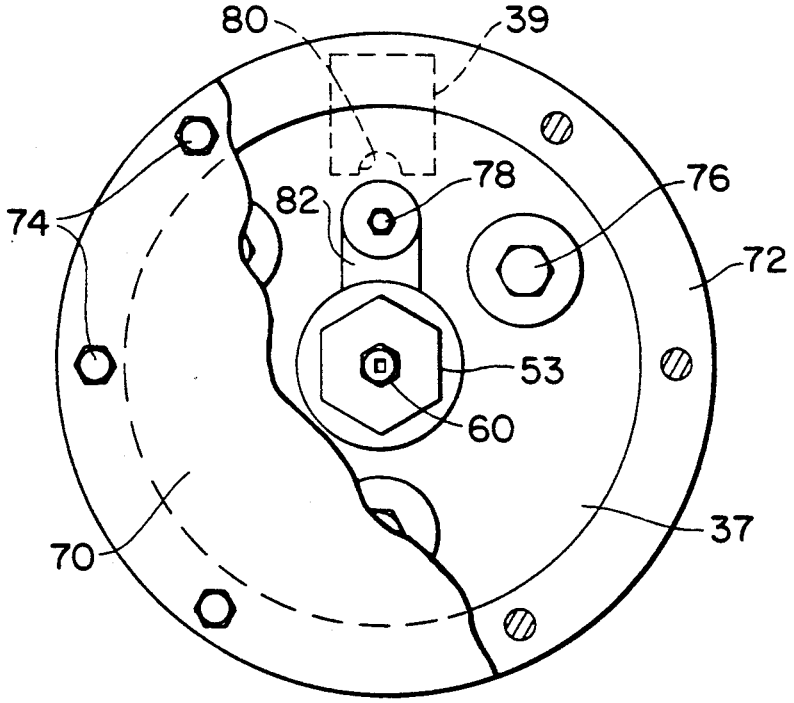
FIG. 4 is a front elevational view, with portions cut away, of the retainer, retainer cover and associated parts of FIG. 3.

Referring to the drawings in particular, where the same reference numerals are utilized to designate the same or similar parts, the invention embodied in FIGS. 3 and 4 comprise a roll wheel assembly for a pulverizer, the assembly having a lip seal assembly 32 for separating an oil space 84, 50 from a seal air space 62, 82. According to the present invention, the key 38 of FIG. 1 is replaced by a slotted key 39 with a channel 80 which communicates an inner part 62 of the seal air space immediately adjacent and around seal 32, with an outer part 82 of the space which is in cavities defined in a modified shaft retainer 37. Retainer 37 is bolted to shaft 12 by bolts 76 which are positioned in counter-sunk holes in the face of retainer 37. A central hole in the retainer 37 also receives a modified oil plug 53 into which is threaded a relocated pop off relief valve 60. In this way relief valve 60 receives any expanding gases from the oil conduit 50, for venting these gases into the outer air seal space 82.

Retainer 37 is also shaped to establish communication with a lubrication fitting 78 which closes the lubrication channel 56.

To close the existing port in roll seal sleeve 34 for valve 60, a plug 85 is installed. This plug stops communication between oil space 84 and seal air space 62.

To close the now expanded air seal space 82, a retainer cover 70 is bolted by bolts 74 to retainer 37 with a gasket 72 between the cover and the retainer.

In the embodiment of FIGS. 3 and 4, in order to inspect, clean or change pop off relief valve 60, operation of the pulverizer must stop and personnel must simply remove the retainer cover 70. This is a far easier operation than dismounting the roll wheel assembly and then disassembling this structure (an operation that normally requires 100 man hours).

In an alternate embodiment of the invention, the channel 80 rather than being cut into the modified key 39, is cut into the key-way of shaft 12. In a further modification, key 39 is simply made to be loose fitting within the key-way. These or any other structures can be utilized to establish communication between the inner and outer portions of the air seal space 62, 82.

Figure 2:
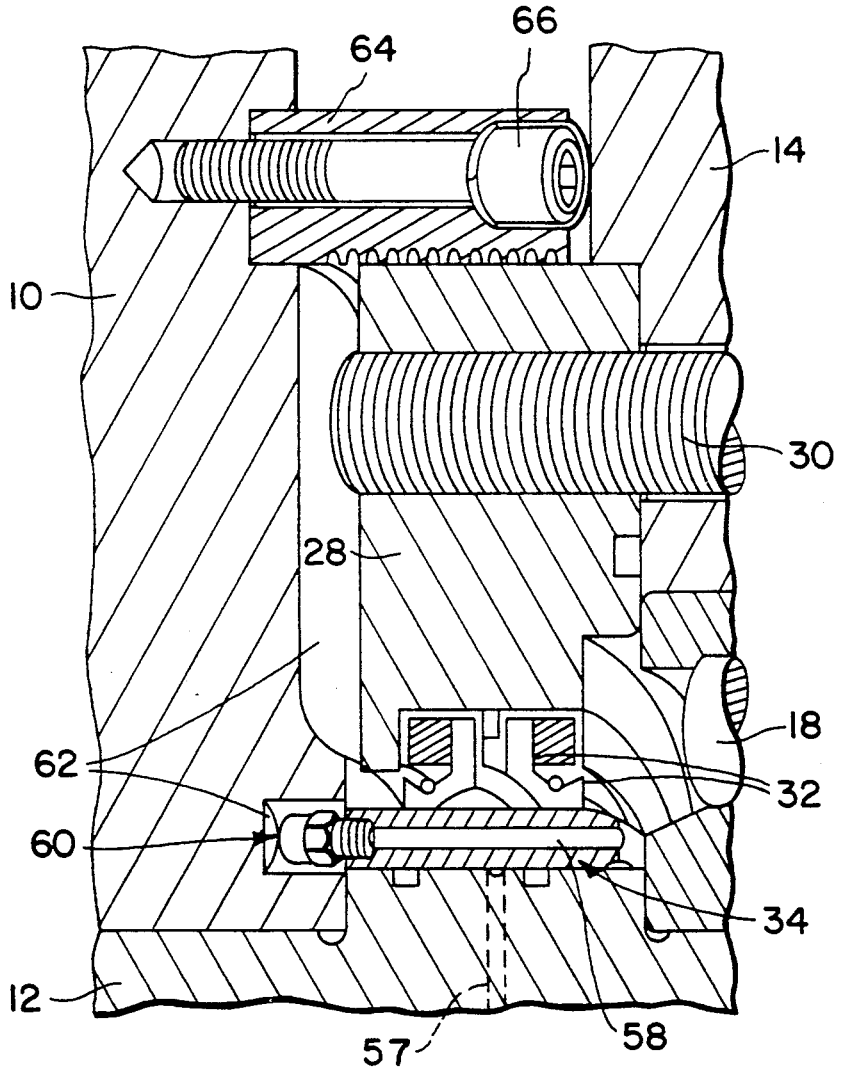
FIG. 2 PRIOR ART
FIG. 2 is an enlarged sectional detail of FIG. 1.

The remaining elements in FIGS. 3 and 4 are the same as those for FIGS. 1 and 2 where the same reference numerals are utilized.

Figure 5:
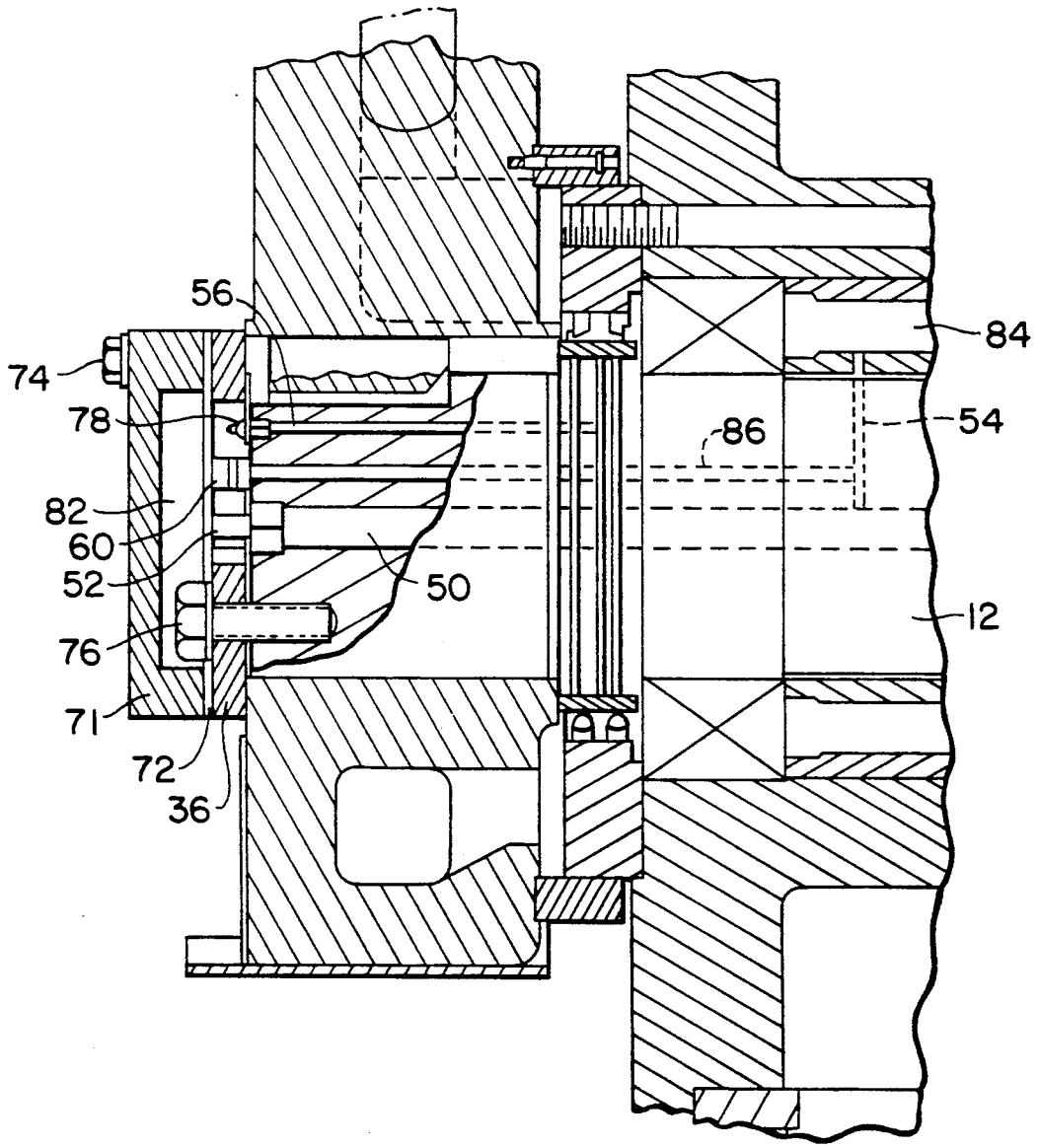
FIG. 5 is a view similar to FIG. 3 of an alternate embodiment of the present invention.

The same is true in FIG. 5 which shows a further embodiment of the invention wherein an oil gas vent channel 86 is drilled into shaft 12, in the axial direction and parallel to oil conduit 50, for communicating the radial extension 54 of the oil conduit with the outer face of shaft 12. The pop off relief valve 60 is threaded into the outer end of channel 86, again for establishing communication between the oil space 84 and the air space 82. A cup shaped retainer cover 71 is bolted by bolts 74 and through a gasket 72 to the retainer 36 which is like the retainer in the prior art. Also, as with the embodiment of FIG. 1, the preexisting port for the relief valve as originally located, is plugged by plug 52.

An advantage of the embodiment of FIG. 5 over the embodiment of FIG. 3 is that the channel means 86 is positioned higher than the channel means of conduit 50 so that expanding gases are better accumulated in channel 86.

While in accordance with provisions of the statutes a specific embodiment of the present invention has been shown and described herein in detail to illustrate the application and principles of the invention, it is not intended that the present invention be limited thereto. Certain modifications and/or improvements will occur to those skilled in the art upon reading the foregoing description and it will thus be appreciated that certain features of the invention may sometimes be used without a corresponding use of the other features; as such the invention may be embodied otherwise without departing from such principles. It is thus understood that all such modifications and/or improvements have been deleted herein for the sake of conciseness and readability but are properly within the spirit and scope of the following claims.

What is claimed is:

1. A pulverizer roll wheel assembly, comprising:

a roller bracket having an opening therein;

a roller shaft having an outer end mounted to said roller bracket in said opening thereof, said outer end of said roller shaft having an end face extending at least partly across said opening, said roller shaft having an inner end;

a roller wheel with a pulverizer tire mounted thereto;

bearing means, connected between said inner end of said roller shaft and said roller wheel, for rotatably mounting said roller wheel to said roller bracket, said inner end of said roller shaft and said roller wheel defining an oil seal space, said outer end of said roller shaft and said roller bracket defining an air seal space;

air seal space expansion means, connected to said roller shaft and extending over at least part of said end face on said outer end of said roller shaft, for expanding said air seal space over said end face of said roller shaft to form an expanded outer seal air cavity;

lip seal means, connected between said roller shaft and said roller bracket, for separating said oil seal space from said air seal space;

oil conduit means, extending axially along and in said roller shaft, for communicating said oil seal space with said expanded outer seal air cavity over said end face of said roller shaft;

a plug connected to said roller shaft for closing an outer end of said oil conduit means, a radial conduit extension, connected between said oil conduit means and said bearing means, for supplying oil between said oil conduit means and said bearing means, and a vent channel in said roller shaft, extending between said outer end face of said roller shaft and said radial conduit extension; and a pop off relief valve, connected to said roller shaft and closing an outer end of the outer seal air cavity.

2. An assembly according to claim 1, wherein said inner end of said roller shaft has an inner end face, said oil conduit means extending from said outer end face to said inner end face, said pop off relief valve being fixed to said roller shaft at said outer end face.

3. An assembly according to claim 1, wherein said air seal space expansion means comprises;

a roller shaft retainer fixed to said outer end face of said roller shaft for retaining said roller shaft on said roller bracket, said retainer having an opening therethrough in which said pop off relief valve extends, and a retainer cover fixed to said retainer and over said opening of said retainer, said opening of said retainer communicating with said expanded outer seal air cavity.

4. An assembly according to claim 3, wherein said retainer cover is cup shaped.

5. An assembly according to claim 1, wherein said outer end of said roller shaft includes a key-way, said key-way extending from said air seal space defined by said outer end of said roller shaft and by said roller bracket, to said expanded outer seal air cavity around said outer end face of said roller shaft, a key in said key-way, and channel forming means between said key and said key-way for communicating an inner part of said air seal space with said expanded outer seal air cavity.

6. An assembly according to claim 4, wherein said channel forming means comprises a channel in said key.

7. An assembly according to claim 4, wherein said channel forming means comprises a channel cut into said key-way in said roller shaft.

8. An assembly according to claim 5, wherein said channel forming means comprises a loose fitting key within said key-way.

9. An assembly according to claim 1, wherein said vent channel is above said oil conduit means when said assembly is mounted in a pulverizer.

10. A pulverizer roll wheel assembly, comprising:

a roller bracket having an opening therein;

a roller shaft having an outer end mounted to said roller bracket in said opening, said outer end of said roller shaft having an end face extending at least partly across said opening, said roller shaft having an inner end;

a roller wheel with a pulverizer tire mounted thereto;

bearing means, connected between said inner end of said roller shaft and said roller wheel, for rotatably mounting said roller wheel to said roller bracket, said inner end of said roller shaft and said roller wheel defining an oil seal space, said outer end of said roller shaft and said roller bracket defining an air seal space;

lip seal means, connected between said roller shaft and said roller bracket, for separating said oil seal space from said air seal space;

air seal space expansion means, connected to said roller shaft and extending over at least part of said end face on said outer end of said roller shaft, for expanding said air seal space over said end face of said roller shaft to form an expanded outer seal air cavity;

oil conduit means, extending axially along and in said roller shaft, for communicating said oil seal space with said expanded outer seal air cavity over said end face of said roller shaft; and a modified oil plug connected to said roller shaft for closing an outer end of said oil conduit means and for receiving a pop off relief valve which receives any expanding gases from said oil conduit means and vents said gases into said expanded outer seal air cavity.

11. An assembly according to claim 12, wherein said air seal space expansion means comprises:

a modified retainer connected to said outer end face for retaining said roller shaft to said roller bracket, said modified retainer having an opening therethrough in which said pop off relief valve extends, and a retainer cover fixed to said modified retainer for closing the expanded portion of said air seal space over said outer end face of said roller shaft to form said expanded outer seal air cavity.

12. An assembly according to claim 10, wherein said outer end of said roller shaft includes a key-way, said key-way extending from said air seal space defined by said outer end of said roller shaft and by said roller bracket, to said expanded outer seal air cavity around said outer end face of said roller shaft, a key in said key-way, and channel forming means between said key and said key-way for communicating an inner part of said air seal space with said expanded outer seal air cavity.

13. An assembly according to claim 12, wherein said channel forming means comprises a channel in said key.

14. An assembly according to claim 12, wherein said channel forming means comprises a channel cut into said key-way in said roller shaft.

15. An assembly according to claim 12, wherein said channel forming means comprises a loose fitting key within said key-way.

* * * * *